United States Patent [19]

Cole et al.

[11] 4,229,399

[45] Oct. 21, 1980

[54] PROCESS FOR PELLETIZING AND NEUTRALIZING SOLID MIXTURES OF METAL CHLORIDES

[75] Inventors: Donald G. Cole; Achim Hartmann, both of Pulheim; Achim M. Kulling; Hermann B. Trüb, both of Leverkusen, all of Fed. Rep. of Germany

[73] Assignee: NL Industries, Inc., New York, N.Y.

[21] Appl. No.: 932,551

[22] Filed: Aug. 10, 1978

[30] Foreign Application Priority Data

Aug. 13, 1977 [DE] Fed. Rep. of Germany ..... 2736622

[51] Int. Cl.[3] ..... C09C 1/28

[52] U.S. Cl. ..... 264/117; 264/6; 264/9; 264/15; 264/109; 423/53; 423/142; 423/158

[58] Field of Search ..... 423/53, 142, 594, 595, 423/593, 158; 264/109, 117, 6, 9, 15

[56] References Cited

U.S. PATENT DOCUMENTS

| | | | |
|---|---|---|---|
| 1,736,659 | 11/1929 | Mitchell | 423/142 |
| 3,219,434 | 11/1965 | Globus | 423/53 |
| 3,375,066 | 3/1968 | Murakami et al. | 423/142 |
| 3,409,427 | 11/1968 | Bonnivard | 423/53 |
| 3,696,519 | 10/1972 | Pefferman | 423/76 |
| 3,867,515 | 2/1975 | Bohl | 264/109 |
| 3,977,892 | 8/1976 | Crossmore | 264/117 |

*Primary Examiner*—Donald J. Arnold
*Attorney, Agent, or Firm*—Gary M. Nath

[57] ABSTRACT

A process is provided wherein solid mixtures of metal chlorides of, for example, ferric chloride, ferrous chloride, vanadium chloride and chromium chloride are (1) mixed with an alkaline material such as, for example, calcium oxide, calcium hydroxide and calcium carbonate, followed (2) by adding water to the resulting mixture to granulate said mixture whereby the metal chlorides are rendered substantially insoluble in water.

5 Claims, No Drawings

PROCESS FOR PELLETIZING AND NEUTRALIZING SOLID MIXTURES OF METAL CHLORIDES

RELATED APPLICATIONS

This application is based upon an earlier filed application in Germany under Patent Application No. P 2736622.9, filed Aug. 13, 1977, for which priority rights under the International Convention are requested.

FIELD OF INVENTION

The present invention relates to a process for the treatment of solid mixtures. More particularly, the invention concerns a process for treating solid mixtures comprising iron chlorides with an alkaline reacting substance and water.

BACKGROUND OF INVENTION

In the chlorination of titanium-containing raw materials, particularly ilmenite, there is formed in great quantity a mixture of solid, dust-forming, chlorides containing an iron chloride. This mixture of chlorides will be referred to as "chlorination dust" hereinbelow. The chlorination dust contains, in addition to iron (II) chloride and/or iron (III) chloride, other chlorides such as, for example, chlorides of vanadium and chromium, small amounts of titanium tetrachloride and HCl as well as cokes, titanium-containing starting material and additional substances, which are carried over from the chlorination reactor.

The solids mixture of chlorination dust often displays itself in the form of a very fine dust, which builds a chloride mist in the atmosphere. It possesses a low density. Also, the chlorides of vanadium and chromium are poisonous and water soluble. The chlorination dust material is, therefore, badly transportable in the existing form and can only be stored with difficulty.

It is proposed in U.S. Pat. No. 3,655,344 that the solid mixture of chlorination dust be treated with water and the chromium and vanadium thereby dissolved out, and from the resulting solution, through addition of an alkaline substance, chromium and vanadium be precipitated. The treatment with water and the addition of the alkaline substance can take place simultaneously.

In accordance with U.S. Pat. No. 3,696,519 the solids mixture of chlorination dust is mixed with carbonates of alkaline or alkaline earth metals to tie-up the evolution of fumes. Calcium oxide is ineffective according to this patent.

Also, U.S. Pat. No. 3,867,515 describes a process in which the solids mixture of chlorination dust is made into pellets during addition of water or aqueous solutions or alkali suspensions or acidic substances.

The processes described in the above-mentioned patents are indeed successful in converting the undesirable ingredients of the solids mixture of chlorination dust into a water insoluble form and in obtaining a transportable and storable product. Each of the described processes is, however, characterized by severe disadvantages. For instance, in the process according to U.S. Pat. No. 3,655,344 the treatment is performed in the presence of great quantities of water; great sediment basins are necessary in which the precipitated compounds can be deposited; and, moreover, a filtration step is necessary. According to U.S. Pat. No. 3,696,519 the resulting product is finely divided and therefore difficult to transport; and, additionally, the process is not successful in freely converting iron (II) chloride into insoluble compounds. The process according to U.S. Pat. No. 3,867,515 requires a separate process step for the dissolution or suspension of the alkali substance which produces higher costs. Additionally, the processes described in the above-mentioned patents cannot be adapted to short-time changes in the falling chlorination dust, for a new solution or suspension of alkaline substances must be readily supplied or made available.

There has now been discovered a new process for the treatment of solids mixtures of chlorination dust comprising mainly iron chlorides obtained in the chlorination of titanium-containing raw materials, particularly ilmenite which avoids or overcomes the disadvantages of the processes described in the above-mentioned patents. The solid mixture of chlorination dust treated in accordance with the process of the invention is converted into a good transportable state and the soluble dangerous transformed metal chlorides, particularly those of vanadium and chromium, are converted into water insoluble compounds such as, for example, into hydroxides or oxides.

THE INVENTION

In accordance with the present invention there is provided a process which comprises mixing a solid mixture comprising chlorides of iron, vanadium and chromium with an alkaline material, and thereafter adding water and granulating the resulting mixture.

More specifically, the process of the invention concerns the treatment of solid mixtures mainly containing iron chlorides—as are obtained in the chlorination of titaniferous raw materials, particularly ilmenite—with an alkaline reacting substance comprising mainly calcium oxide and/or calcium hydroxide and/or calcium carbonate and thereafter adding water to the resulting mixtures during which treatment the vanadium and chromium contained in the solid mixture forms compounds insoluble in water, and the solid mixture is granulated, and during which no liquid aqueous phase occurs, especially wherein said solid mixture is first mixed with the alkaline reacting substance in the dry state and the mixture obtained is then granulated by the addition of water.

Preferred embodiments of the process of the invention include that wherein:

(1) The alkaline reacting substance is added at such quantity that a granulate is obtained which, when slurried in water and filtered, results in a filtrate having a pH value in the range between about 4.5 and about 5.0.

(2) A solid mixture, in which up to about 18% of its iron content are present in the trivalent state, is treated with the alkaline reacting substance at a quantity ranging between 8 and 24 percent by weight, calculated as CaO, and related to the chloride ion content of the solid mixture.

(3) The alkaline reacting substance is added at such quantity that a granulate is obtained which, when slurried in water and filtered, results in a filtrate showing a pH value of 9 to 11 or more.

(4) The alkaline reacting substance is used at a quantity ranging between 80 and 120 percent by weight, calculated as CaO, and related to the chloride ion content of the solids mixture.

(5) The water is added at a quantity of 35 to 70 percent by weight of the total input of solid mixture and alkaline reacting substance.

DETAILED DESCRIPTION OF INVENTION

The process of the invention is especially useful for the treatment of solid mixtures, mainly containing iron chlorides obtained in the chlorination of titanium-containing raw materials, particularly ilmenite, with an alkaline reacting substance which is comprised mainly of calcium oxide and/or calcium hydroxide and/or calcium carbonate, in which the solids mixture is granulated, the vanadium and chromium contained therein forming water-insoluble compounds and during which treatment no liquid aqueous phase is formed. A salient feature of the process is that the solid mixture is first mixed with the alkaline reacting substance in the dry state and the mixture obtained is then granulated by the addition of water.

The process is applicable not only in the field of chlorination of ilmenite, but also in the field of the chlorination of other titanium-containing raw materials, for example, rutile, or $TiO_2$ enriched ore concentrate or of titanium and iron-containing slags. Also, the process can be practiced with the work-up of residues which are obtained in the purification of titanium tetrachloride. Such residues contain various particularly vanadium-containing impurities and can be separate jointly with the chlorination dust from the chlorination process. Depending upon the nature of type of raw materials input and the chlorination restrictions, chlorination dusts of a most different composition and other properties as grain size and capacity for wetting are formed. In the chlorination of ilmenite there occurs, for example, a chlorination dust which contains greater quantities of iron chlorides and lesser amounts of other metal chlorides, and little coke content. In this instance, the need in respect to an alkaline reacting substance is great, while the water demand is relatively small. In the chlorination of rutile there occurs, on the other hand, a chlorination dust, which in comparison to the metal chlorides, contains more cokes. In this case, the need in respect to an alkaline reacting substance is less; the water need, on the other hand, is greater. Further, the necessary amount of alkaline reacting substance is dependent upon the proportion of iron (II) chloride to iron (III) chloride, as well as what measure or extent of neutralization is desired or intended. The quantity of water conforms, among other things, according to the physical properties of the dust, as well as, for example, grain size and wetting ability, as well as according to the desired grain size of the granule.

A greater advantage of the process of the invention is that the supply of the alkaline reacting substance, on the one hand, and of water, on the other hand, are regulated independently of one another and can be adjusted quickly and simply to the requirements at any given time. This feature of the process is, among other things, advantageous if short-lived operating disorders are experienced during chlorination which change the composition and other properties of the resulting chlorination dust. The process is, therefore, very flexible. Interruption will not be necessary. The alkaline reacting substance does not have to be suspended or dissolved in a separate process step before its addition. After the granulation, the insoluble compounds formed can easily be separated and allowed to be worked-up separately. This feature of the process is especially advantageous if extraction of the valuable secondary ingredients from the chlorination dust is desired. Thus, the process can be advantageously practiced with a solid mixture which contains overbalancing iron (II) chloride to separate the compounds of vanadium and chromium from iron (II) chloride.

A special performance feature of the process is that the alkaline reacting substance is added in such quantity that a granulate is obtained which after slurrying in water and filtering, produces a filtrate having a pH value between about 4.5 and about 5.0. In this instance, mainly only chlorides of vanadium and chromium as well as iron (III) chloride will be converted into water insoluble compounds, while the iron (II) content remains at least partly water soluble. The necessary quantity of alkaline reacting substances increases, among other things, according to the proportion of iron (III) chloride to iron (II) chloride and is greater the more this proportion of iron (III) chloride is displaced. This execution of the process is especially advantageous with iron (II) chloride-rich chlorination dusts. In this instance, vanadium and chromium will be separated in a relative concentrated form and can be easily separated from the iron chlorides and worked-up or recovered. A favorable development of this execution of the process is characterized in that a solid mixture, in which up to about 18% of its iron content is present in the trivalent state, is treated with the alkaline reacting substance in a quantity of 8 to 24 weight percent, calculated as CaO and related to the chloride ion content of the solids mixtures.

A further execution of the process of the invention is that the alkaline reacting substance is added in such quantity that a granulate is obtained which, after slurrying in water and filtering, forms a filtrate having a pH value of 9 to 11. The pH value can, under circumstances, be even still higher. In this instance, beside the vanadium and chromium, the total iron will be converted into water insoluble compounds. This procedure is then particularly advantageous if the entire treated mixture is to be transported to a dump or discarded. It is usually necessary in this case to add the alkaline reacting substance in a quantity of between about 80 and about 120 weight percent, calculated as CaO and related to the chloride ion content of the solids mixtures. The added quantity can be even still higher. In this execution of the process calcium oxide and/or calcium hydroxide is preferably utilized. In this way, the pH standard is reached more quickly and secured above all, that even the divalent iron is made completely insoluble.

The granulation may be accomplished, for example, by means of a revolving plate or in rotary tubes. The water is generally used in an amount of 35 to 70 weight percent, based upon the total input of solid mixture and alkaline reacting substance.

EXAMPLES

EXAMPLE 1

1000 G. of chlorination dust containing mainly the following ingredients, in weight percent:

$FeCl_2$: 60.6
$FeCl_3$: 4.9
Cr: 0.10
V: 0.03 and having a pouring density of 260 g./l. were mixed in the dry state with 55 g. of ordinary commercial quicklime (CaO content about 86 weight percent). The mixture obtained was taken to a pellet plate, and slowly 680 ml of water was added. Odorless pellets having a pouring density of 980 g./l. were obtained.

One part of these pellets, corresponding to 25 g. of the chlorination dust added, were crushed and stirred for 30 minutes in 400 ml. tap water at room temperature and filtered. The filtrate obtained showed a pH value of 4.6. The residue was washed, the wash water added to the filtrate, and the liquid mixture so obtained adjusted with water to 1000 ml. The end solution obtained contained 6.7 g./l. iron, less than 0.1 mg./l. chromium, and less than 0.1 mg./l. vanadium.

For comparative purposes, an untreated chlorination dust (25 g.), without previous treatment with quicklime as in Example 1, above, was stirred in tap water and filtered. The filtrate possessed a pH value of 2.6 and the end solution contained 7.1 g./l. iron, 26 mg./l. chromium, and 7 mg./l. vanadium.

By contrast, in the treatment according to Example 1, above, the iron was made only in slight measure water insoluble and the vanadium and chromium were made practically completely water insoluble.

EXAMPLE 2

The procedure described in Example 1 was repeated, except that 500 g. of the quicklime was added. The pellets obtained had a pouring density of 780 g./l., and the pH value of the filtrate amounted to over 11. The end solution obtained through addition of the washings of the residues to the filtrate and adjusting to 1000 ml. contained 0.7 mg./l. iron, 0.05 mg./l. chromium, and 0.2 mg./l. vanadium. Besides vanadium and chromium, also the iron was made practically completely water insoluble.

EXAMPLE 3

1000 G. of a chlorination dust which contained the indicated ingredients in the following quantities (in weight percent):

$FeCl_2$: 66.1
$FeCl_3$: 5.3
Cr: 0.11
V: 0.08 were mixed in the dry state with 100 g. limestone dust ($CaCO_3$ content of 95 weight percent), and the mixture was further worked-up as in Example 1. The pellets had a pouring density of 720 g./l., the pH value of the filtrate was 4.9, and the end solution contained 7.3 g./l. iron, 0.13 mg./l. chromium, and less than 0.1 mg./l. vanadium.

EXAMPLE 4

From a chlorination reactor, 750 kg./h. of chlorination dust of the composition described in Example 3 were delivered at a temperature of 200° C. To this dust was mixed in a continuous screw mixer 340 kg./h. of ordinary commercial quicklime (86% CaO), whereby the hold-up time in the screw mixer amounted to about 3 minutes. After that, the mixture at a temperature of about 100° C. was directed continuously to a pellet plate, and 500 kg./h. of water were added. Pellets with a density of 820 g./l. and a grain size of 0.5 to 2 cm. were obtained. Examination of the pellets as in Example 1 yielded a filtrate with a pH value of over 11, and the end solution showed a content of less than 0.5 mg./l. iron, less than 0.05 mg./l. chromium, and 0.11 mg./l. vanadium.

What is claimed is:

1. A process for treating a solid mixture containing chlorides of iron, vanadium and chromium, obtained in the chlorination of titaniferous raw materials which comprises forming a granulate by mixing in a dry state said solid mixture with an alkaline reacting substance selected from the group consisting of calcium oxide, calcium hydroxide, calcium carbonate, and mixtures thereof, whereby the chlorides of vanadium and chromium form compounds substantially insoluble in water, and thereafter granulating the resulting mixture by adding water at a quantity of 35 to 70 percent by weight, and forming pellets thereof.

2. The process of claim 1 wherein the alkaline reacting substance is added at such quantity that a granulate is obtained which, when slurried in water and filtered, results in a filtrate showing a pH value in the range of 4.5 to 5.0.

3. The process of claim 2 wherein a solid mixture having up to about 18% of its iron content present in the trivalent state is treated with the alkaline reacting substance at a quantity ranging between 8 and 24 percent by weight, calculated as CaO and related to the chloride ion content of the solid mixture.

4. The process of claim 1 wherein the alkaline reacting substance is added at such quantity that a granulate is obtained which, when slurried in water and filtered, results in a filtrate showing a pH value of about 9 to 11 or greater.

5. The process of claim 1 wherein the alkaline reacting substance is used at a quantity ranging between about 80 and about 120 percent by weight, calculated as CaO and related to the chloride ion content of the solid mixture.

* * * * *

UNITED STATES PATENT OFFICE

CERTIFICATE OF CORRECTION

Patent No. 4,229,399 Dated October 21, 1980

Inventor(s) Donald G. Cole, Achim Hartmann, Achim M. Kulling & Hermann B. Trub

It is certified that error appears in the above-identified patent and that said Letters Patent are hereby corrected as shown below:

Assignee: "NL Industries, Inc., New York, N.Y." should read --Kronos Titan G.m.b.H., Leverkusen, Federal Republic of Germany--.

Signed and Sealed this

Sixteenth Day of June 1981

[SEAL]

Attest:

RENE D. TEGTMEYER

Attesting Officer

Acting Commissioner of Patents and Trademarks